United States Patent [19]

Zorini

[11] Patent Number: 4,699,331

[45] Date of Patent: Oct. 13, 1987

[54] CREEL STRUCTURE TO SUPPORT WARP AND WEFT YARN DELIVERY BOBBINS IN LOOMS

[75] Inventor: Luigi O. Zorini, Cilavegna, Italy

[73] Assignee: Comez S.p.A., Cilavegna, Italy

[21] Appl. No.: 937,073

[22] Filed: Dec. 2, 1986

[30] Foreign Application Priority Data

Mar. 28, 1986 [IT] Italy ..... 21374/86[U]

[51] Int. Cl.[4] ..... B65H 49/04

[52] U.S. Cl. ..... 242/131

[58] Field of Search ..... 242/131, 131.1, 130; 28/190, 193; 66/125 R; 139/450

[56] References Cited

U.S. PATENT DOCUMENTS

| | | | |
|---|---|---|---|
| 1,547,596 | 7/1925 | Longvall | 242/131.1 |
| 2,542,097 | 2/1951 | Shaffer et al. | 242/131.1 |
| 2,615,653 | 10/1952 | Atkins et al. | 242/131.1 |
| 3,321,153 | 5/1967 | Bryan, Jr. | 242/131 |
| 3,452,947 | 7/1969 | Thurman | 242/131 |
| 3,753,274 | 8/1973 | Koslowski | 242/131.1 X |
| 3,848,829 | 11/1974 | Womer | 242/131 |
| 4,498,644 | 2/1985 | Kupper et al. | 242/131.1 |
| 4,538,776 | 9/1985 | Perry | 242/131 |

FOREIGN PATENT DOCUMENTS 1372010 10/1974 United Kingdom ..... 242/131

*Primary Examiner*—Stanley N. Gilreath

*Attorney, Agent, or Firm*—Laff, Whitesel, Conte & Saret

[57] ABSTRACT

The creel structure of the invention comprises a supporting framework 2 consisting of posts 3 and cross-pieces 4 disposed according to a parallelepiped configuration and a secondary frame 5 consisting of two cross-pieces 6 and a number of posts 7 each of them being provided with supports 8 for the bobbins 9 extending in opposite direction towards opposed parallel planes defined by the most extending surfaces of the parallelepiped framework configuration. In each of said planes an alveolus-like structure 11 formed of hexagonal meshes 12 extends and to each of said meshes is fastened a first thread tension device 13, said supports for the bobbins being distributed according to a symmetrically offset configuration. Second thread tension devices 28 are provided and they are located on support bars 29 mounted in cantilevered fashion on the posts 3 of the supporting framework 2, the second thread tension devices 28 of each support bar 29 corresponding to one horizontal row of the supports 8.

6 Claims, 7 Drawing Figures

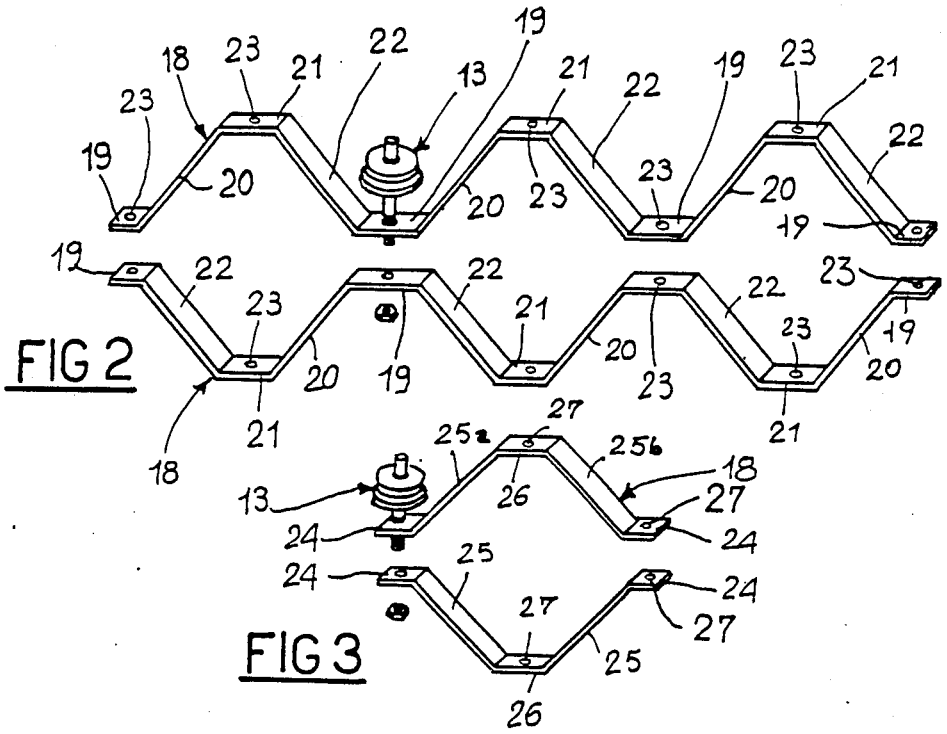
18
23
21
22
13
19
20
FIG 2
FIG 3
24
25
25a
25b
26
27
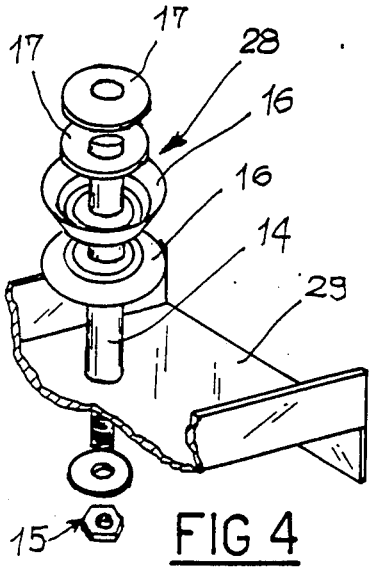
17
28
16
14
29
15
FIG 4
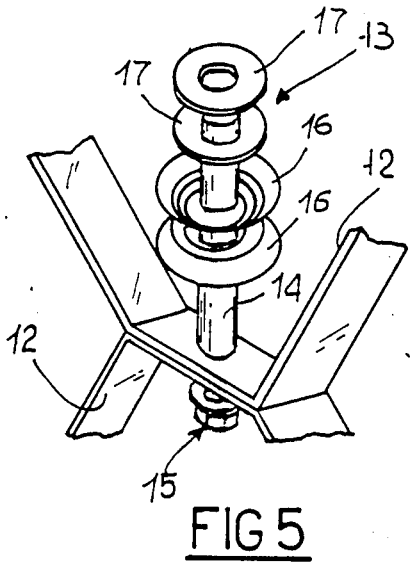
17
13
16
12
14
15
FIG 5

CREEL STRUCTURE TO SUPPORT WARP AND WEFT YARN DELIVERY BOBBINS IN LOOMS

FIELD AND BACKGROUND OF THE INVENTION

The present invention pertains to a creel structure for supporting warp and weft yarn delivery bobbins in looms.

It is known that creels in general are particular types of racks that are combined with looms in order to support the corresponding warp and weft yarn delivery bobbins, as well as to allow an easy and regular simultaneous unwinding of said yarns from the corresponding bobbins.

In this connection currently used creels comprise a supporting framework consisting of a number of posts and cross-pieces disposed so as to form a parallelepiped configuration. Inside said supporting framework there is a secondary frame comprising two or more cross-pieces with which a number of posts is engaged. Each of the latter is provided with a plurality of support elements adapted to engage the bobbins. The support elements are suitably spaced apart according to a predetermined pitch and extend in opposite directions, towards the parallel and opposed planes defined by the most extending surfaces of the above mentioned parallelepiped configuration.

A plurality of secondary cross-pieces is also located in said planes, each of them exhibiting a number of thread tension devices corresponding each to a support element.

On two of the posts in the supporting framework a number of drawing-in bars is also mounted in cantilevered fashion, each of them being disposed at right angles to a corresponding secondary cross-piece and equipped with a number of horizontal through holes to each of them one of the thread tension devices provided on the secondary cross-piece itself corresponds.

After the above short description it is apparent that the setting up of creels always involves many problems, essentially due to the fact that, as they must be capable of housing a great number of bobbins, creels have an important bulkiness. In this respect currently used creels have proved to be susceptible of improvements.

It is in fact to be noted firstly that the presence of said secondary cross-pieces involves the necessity of disposing the support elements in mutual alignment not only in the vertical direction but also in the horizontal one. That gives rise to the presence of rather important empty spaces between the adjoining bobbins aligned in the vertical direction, which spaces cannot be exploited at all and therefore result in a useless increase in the bulkiness of the corresponding creel. To make the situation worse there is also the fact that, owing to the presence of the above mentioned thread tension devices, the secondary bars must be spaced apart from each other according to a greater pitch than the bobbin sizes would require. In fact, should not this be the case, it would be impossible to replace the bobbins during the operation of the creel, since the same have to pass through the secondary bars above the corresponding thread tension devices.

Currently used creels have disclosed disadvantages also as to the correct delivery of yarns to the respective looms. In this connection it is known that each delivery yarn in the length thereof included between the corresponding bobbin and thread tension device, is subjected to entanglements resulting in the formation of loops, due to the fact that it periodically suffers from spontaneous drops and consequent unwindings from the bobbin itself. So it often happens that a loop may pass through the thread tension device and then come untied downstream of the same. Under this situation the optimum tensioning of the delivery yarn is impaired and, as a result, the complete stopping of the loom occurs due to the intervening of delivery yarn tensioning detecting devices interlocked to the loom itself.

OBJECTS

The object of the present invention is therefore to eliminate the drawbacks found in known art, as far as possible, by providing a creel exhibiting a bigger bobbin capacity, sizes being equal, or, viceversa, a less bulkiness, the bobbin capacity being equal.

A further object is to provide a creel adapted to give the delivery yarns an evener tensioning than the one achieveable with known solutions.

SUMMARY OF THE INVENTION

The foregoing and further objects that will become more apparent from the following description are substantially attained by a creel structure adapted to support warp and weft yarn delivery bobbins in looms, comprising a supporting framework consisting of posts and cross-pieces disposed according to a parallelepiped configuration and rigidly connected to each other, and having a secondary frame inside it, which is composed of at least two cross-pieces and a number of posts along each of them a plurality of supports is distributed for the engagement of said bobbins extending in opposite directions towards parallel and opposed planes defined by the most extending surfaces of the parallelepiped configuration exhibited by said framework, as well as a number of first thread tension devices distributed in said planes, to each of said first thread tension devices corresponding one of said supports; wherein in said planes an alveolus-like structure formed of hexagonal meshes is located, to each of said meshes being fastened one of said first thread tension devices, each of said posts constituting said secondary frame having its respective supports symmetrically offset with respect to the supports of the adjoining posts.

BRIEF DESCRIPTION OF THE DRAWINGS

Further features and advantages will become more apparent from the detailed description of a preferred embodiment of a creel adapted to support warp and weft yarn delivery bobbins in looms having the structure according to the present invention, given hereinafter by way of non-limiting example with reference to the accompanying drawings, in which:

FIG. 2 is a perspective and exploded view of one embodiment of the structure adapted to support the thread tension devices in the creel of the invention;

FIG. 3 is a perspective and exploded view of a second embodiment of the structure adapted to support the thread tension devices in the creel of the invention;

FIG. 4 is a perspective and exploded interrupted view to an enlarged scale of a detail of the creel according to the present invention;

FIG. 5 is a perspective and exploded interrupted view to an enlarged scale of a further detail of the creel according to the present invention;

DESCRIPTION OF THE PREFERRED EMBODIMENTS

Figure 1:
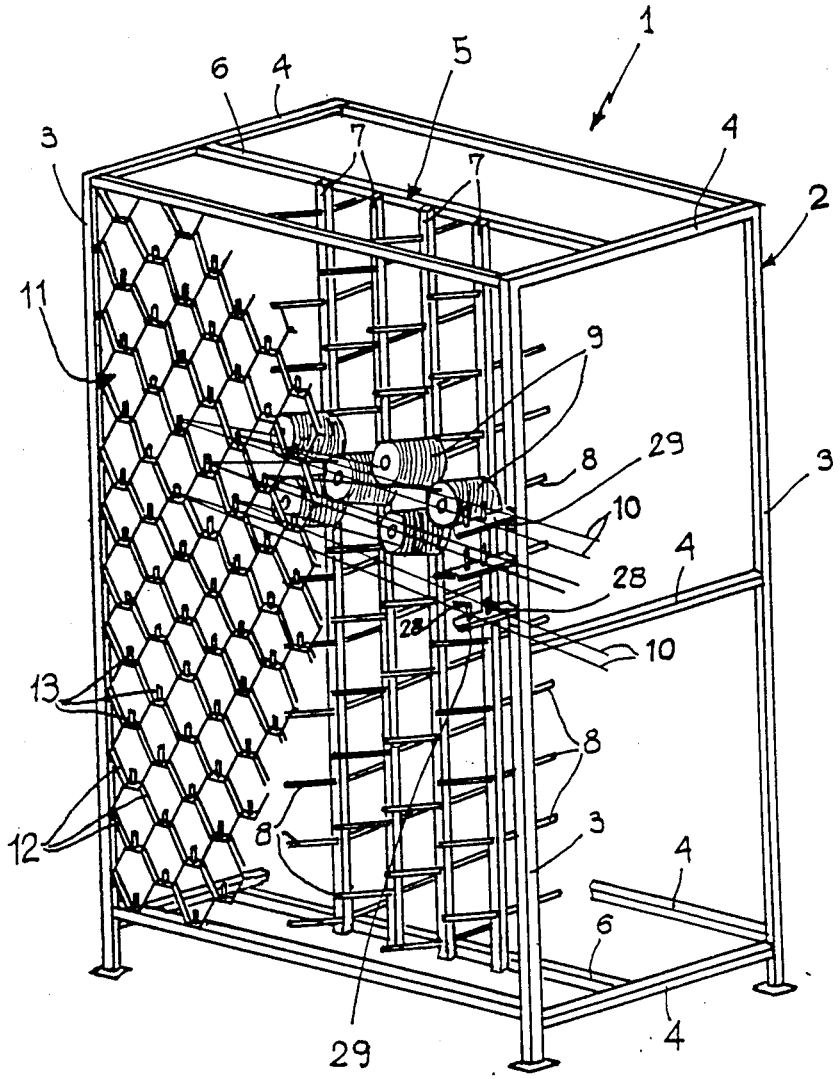
FIG. 1 is a diagrammatic and perspective view of a creel having the structure according to the invention.

Referring to the drawings and particularly to FIG. 1, a creel adapted to support warp and weft yarn delivery bobbins in looms, having the structure according to the present invention has been identified by reference numeral 1.

Creel 1 comprises a supporting framework 2 consisting of posts 3 and cross-pieces 4 disposed so as to form a parallelepiped configuration and rigidly connected to each other in a conventional manner. Inside the supporting framework 2 there is a secondary frame 5 comprising two or more cross-pieces 6 between which a plurality of posts 7 extends, said posts being suitably spaced apart from each other according to a predetermined pitch. For the sake of clearness, only some of said posts 7 have been shown in FIG. 1.

Furthermore, a plurality of supports 8 is disposed on each post 7, each of said supports being designed to removably engage a bobbin 9 adapted to deliver a respective warp or weft yarn 10 to the loom interlocked to the creel 1. As it is possible to note, the supports 8 are spaced apart along the respective posts according to a predetermined pitch and lead off therefrom according to opposite directions towards the opposed and parallel planes defined by the most extending surfaces of the above mentioned parallelepiped configuration.

Furthermore and advantageously, the supports 8 of each post 7 appear symmetrically offset, in the vertical direction, relative to the supports 8 of the adjoining posts 7, thus giving the creel 1 the advantages to be disclosed hereinafter.

The offset arrangement of the supports 8 is made possible, in accordance with the present invention, by virtue of the presence of an alveolus-like structure 11 formed of a number of hexagonal meshes 12 in the planes defined by the most extending surfaces of the above mentioned parallelepiped configuration.

On the base side of each hexagonal mesh 12 is fixedly mounted, as best seen in FIG. 5, one thread tension device 13 extending in a vertical direction and structured in a known and conventional manner. In greater detail, each first thread tension device 13 comprises a support pin 14 which is fastened to the base side of the corresponding hexagonal mesh 12 by means of first screw threaded members 15. A pair of thread tension plates 16 is coaxially located in a specular manner on said support pin 14, as well as one or more adjustment weights 17; the function of these members will be explained in the following.

Referring particularly to FIGS. 2 and 3, the alveolus-like structure 11 can be accomplished according to different embodiments.

In one embodiment shown in FIG. 2 it is provided that a plurality of laminar elements 18 is used, each of them having a longitudinal extension obtained by the sequential repetition of a first horizontal portion 19 followed by a second rectilinear sloping portion 20, in turn followed by a third horizontal portion 21, from which a fourth rectilinear portion 22 lead off inclined in the opposite direction with respect to the portion identified at 20. As it is possible to see, the laminar elements 18 are disposed in a specular manner and are rigidly connected to each other by the engagement of the first thread tension devices 13 into through holes 23 pierced in the first 19 and third 21 horizontal portions.

Obviously the length of the laminar elements 18 has not a binding character to the ends of the present invention. In fact it may be provided that each of said elements extends between the two posts 3 of the supporting framework but said elements may also be shorter, as in the case shown in FIG. 2. Obviously in the latter case it will be necessary to connect several laminar elements 18 disposing them one after the other so that the first portions 19 are in register with each other in order to perform an alveolus-like structure horizontally extending between the two posts of the supporting framework 2.

FIG. 3 refers to a further embodiment of the alveolus-like structure 11 based on the same construction conceipt as hereinbefore discussed with referece to FIG. 2.

Referring to FIG. 3, in fact, each laminar element 18 may exhibit, in a horizontal direction, two first end portions 24 coplanar with each other and horizontally disposed, between which two second rectilinear sloping and converging portions 25*a* and 25*b* extend, the latter being joined to each other by a third intermediate portion 26 coplanar with the first two end portions 24.

Similarly to what described with reference to the embodiment shown in FIG. 2, in this case too the laminar elements 18 are disposed in a specular manner and rigidly connected to each other by the engagement of the first thread tension devices 13 into through holes 27 pierced in the first 24 and third 26 horizontal portions.

Looking through the accompanying drawings it is also possible to note that the first and third horizontal portions 19 and 21 or 24 and 26 of the laminar elements 18 are anyway shorter than the sloping portions 20 and 22 or 25*a* and 25*b* contiguous thereto. In this manner the opposted horizontal sides of each hexagonal mesh 12 are shorter than the other sides of the hexagonal mesh itself. This configuration enables the first thread tension devices 13 to be disposed on the hexagonal meshes 12 without their hindering the passage of the bobbins 9 through said hexagonal meshes 12 during the use of creel 1, which condition is necessary in order to allow the arrangement of the bobbins 9 on the corresponding supports 8.

In this connection it must be pointed out that in a preferred embodiment, the length of the first portions 19 or 24 and of the third portions 21 or 26 is inversely proportional to the height of the first thread tension devices 13.

The alveolus-like structure 11 is globally fastened to posts 3 and to cross-pieces 4 of the supporting framework 2, by means of screw threaded members in the region of the first portions 19 or 24 and of the third portions 21 or 26 of the laminar elements 18 located at the ends of the alveolus-like structure 11 itself. For the purpose the first portions 19 or 24 of the laminar elements 18 designed to be connected to post 3 may be advantageously bent in a vertical direction.

According to a further feature of the present invention, a plurality of second thread tension devices 28, of the same type as the first ones 13 is also provided. As shown in FIGS. 1 and 4, they are located on support bars 29, mounted in cantilevered fashion on the posts 3 of the supporting framework 2 and directed at right angles to the plane containing the corresponding alveolus-like structure 11.

In greater detail, the support bars 29 are fastened to the posts 3 disposed on the side of the loom interlocked to the creel 1, spaced apart along the posts themselves according to a predetermined pitch. Each of said bars corresponds to one of the horizontal rows according to which supports 8 are aligned and a plurality of second thread tension devices 28 equal to the number of the supports 8 forming the row itself is therefore combined therewith.

Operation of the creel having the structure according to the present invention and described above mainly as regards construction, is as follows.

Bobbins 9 are brought into engagement on the respective supports 8 after passing through the corresponding hexagonal meshes 12. Afterwards the yarn 10 carried by each bobbin 9 is caused to pass through the thread tension plates 16 of the corresponding first thread tension device 13 and subsequently through the thread tension plates 16 of the second thread tension device 28. From that point each yarn is brought to the loom interlocked to the creel 1 and suitably engaged with the members provided on the loom itself. During the loom operation the yarns 10 are proportionately unwound from the corresponding bobbins 9 by the members constituting the above mentioned loom.

The present invention achieves the proposed objects. In fact, it will be recognized that creels having the structure according to the present invention allow that important advantages with respect to conventional creels may be reached as to the bulkiness of the same.

Figure 6A:
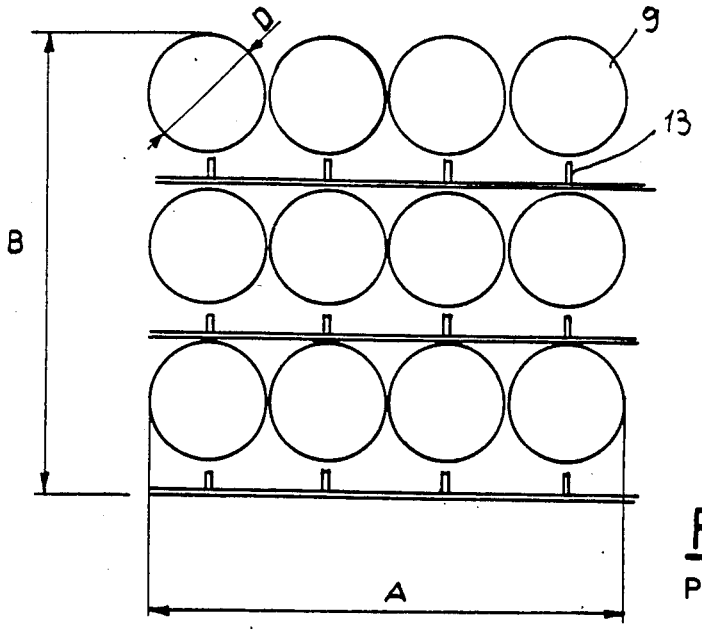
FIG 6a PRIOR ART
FIG. 6*a* is a front view of the mutual arrangement given to the bobbins in creels of known art.
Figure 6B:
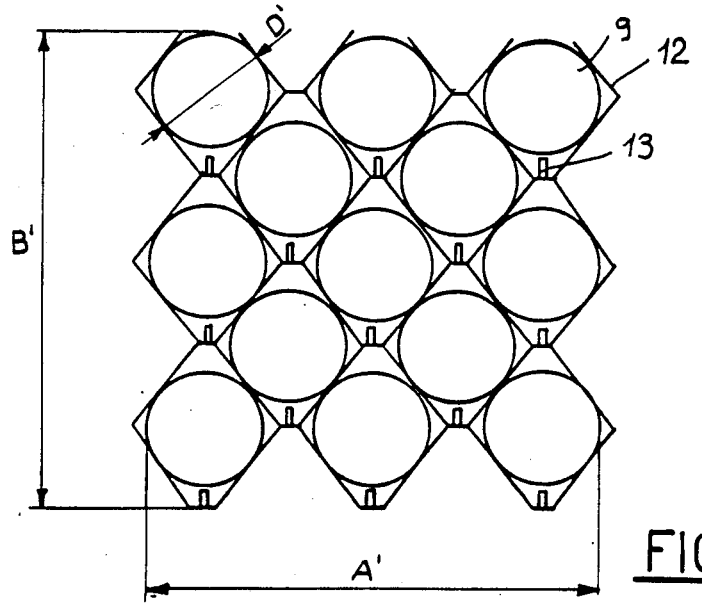
FIG. 6*b* shows the mutual arrangement given to the bobbins in creels of the present invention.

Said advantages become apparent if FIGS. 6*a* and 6*b* are compared. From that comparison it is clear that, while in conventional creels it is possible to dispose twelve bobbins of diameter D in an area the sizes of which are A ×B, in the creel structure according to the present invention it is possible to dispose thirteen bobbins 9 having the same diameter D in an area the sizes of which, A′×B′, are substantially identical to those of the above mentioned area A ×B. With the structure in reference creels are therefore accomplished which are adapted to house a greater number of bobbins, sizes being equal, or viceversa, which have a reduced bulkiness as compared to creels of known type, the number of housed bobbins being equal.

In this connection it is also important to point out that the comparison described above with reference to FIGS. 6*a* and 6*b* has been done taking into account areas having a reduced extension or, in other words, taking into account a reduced number of bobbins. As a result during the comparison the structure in reference has been considered under a remarkably unfavourable point of view due to the presence of the empty spaces between the bobbins located close to the outer border of the defined area. Actually, creels usualy accommodate several hundreds of bobbins and, as a result, the above mentioned empty spaces have a negligible influence on the whole bulkiness of the creel.

Practically it has been foreseen that creels accomplished according to the structure in reference may have a bulkiness reduced of 25–30% as compared to traditional creels, the number of bobbins housed therein being identical.

A further advantage of the creel in reference is given by the presence of the second thread tension devices 28, thanks to which it is possible to ensure a correct feeding with warp and weft yarns to the loom interlocked to the creel 1.

In fact, should a loop formed by a yarn 10 upstream of the corresponding first thread tension device 13 pass through said first thread tension device and come untied downstream of the same, the tensioning of the yarn 10 during its travel between the creel 1 and the loom would not undergo any modification thanks to the presence of the second thread tension device 28.

Obviously, many modifications and variations may be made to the present invention without departing from the scope of the inventive idea characterizing it.

What is claimed is:

1. A creel structure adapted to support warp and weft yarn delivery bobbins in looms, comprising a supporting framework consisting of posts and cross-pieces disposed according to a parallelepiped configuration and rigidly connected to each other, and having a secondary frame inside it, which is composed of at least two cross-pieces and a number of posts along each of them a plurality of supports is distributed for the engagement of said bobbins extending in opposite directions towards parallel and opposed planes defined by the most extending surfaces of the parallelepiped configuration exhibited by said framework; as well as a number of first thread tension devices distributed in said planes, each of said first thread tension devices corresponding to one of said supports; wherein in said planes an alveolus-like structure formed of hexagonal meshes, is located, each of said meshes being fastened to one of said first thread tension devices, each of said posts constituting said secondary frame having its respective supports symmetrically offset with respect to the supports of the adjoining posts.

2. The creel structure as claimed in claim 1, wherein said alveolus-like structure consists of a plurality of laminar elements each of them having a longitudinal extension obtained by the sequential repetition of a first horizontal portion followed by a second rectilinear sloping portion, in turn followed by a third horizontal portion from which a fourth rectilinear portion lead off, being inclined in the opposite direction with respect to said second portion, said laminar elements being disposed in a specular manner and rigidly connected to each other in the region of said first and third horizontal portions by the engagement of said first thread tension devices by means of screw threaded members.

3. The creel structure as claimed in claim 1, wherein it comprises a number of laminar elements exhibiting, in a horizontal direction, two first end portions coplanar with each other, between which two second rectilinear sloping and converging portions extend, the latter being joined to each other by a third intermediate portion extending in a plane parallel to said first end portions, said laminar elements being disposed in a specular manner and rigidly connected to each other by the engagement of said first thread tension devices by means of screw-threaded members in the region of said first end portions and said third intermediate portions.

4. The creel structure as claimed in claim 1, wherein each of said hexagonal meshes exhibits two opposed horizontal sides that are shorter than the other sides of said mesh.

5. The creel structure as claimed in claim 4, wherein the length of said opposed horizontal sides is inversely proportional to the height of said first thread tension devices.

6. The creel structure as claimed in claim 1, wherein it comprises a plurality of second thread tension devices of the same type as the first thread tension devices, which are disposed on support bars mounted in cantilevered fashion on the posts of said supporting framework and substantially directed at right angles to the planes containing said alveolus-like structure, the second thread tension devices of each said support bar corresponding to a horizontal row of said supports.

* * * * *